US007051545B2

(12) United States Patent
Sauter

(10) Patent No.: US 7,051,545 B2
(45) Date of Patent: May 30, 2006

(54) REFRIGERATED DISPLAY CASE AUTOMATIC CLEANING SYSTEM AND METHOD

(76) Inventor: Ronald W. Sauter, 1711 Furnace Dr., Glen Burnie, MD (US) 21060

( * ) Notice: Subject to any disclaimer, the term of this patent is extended or adjusted under 35 U.S.C. 154(b) by 250 days.

(21) Appl. No.: 10/475,651

(22) PCT Filed: Aug. 9, 2002

(86) PCT No.: PCT/US02/25157

§ 371 (c)(1),
(2), (4) Date: Oct. 23, 2003

(87) PCT Pub. No.: WO03/013319

PCT Pub. Date: Feb. 20, 2003

(65) Prior Publication Data

US 2005/0138946 A1 Jun. 30, 2005

Related U.S. Application Data

(60) Provisional application No. 60/310,833, filed on Aug. 9, 2001.

(51) Int. Cl.
*A47F 3/04* (2006.01)

(52) U.S. Cl. ..... 62/249; 62/303

(58) Field of Classification Search ..... 62/78, 62/249, 303; 220/371
See application file for complete search history.

(56) References Cited

U.S. PATENT DOCUMENTS

| | | | | |
|---|---|---|---|---|
| 3,320,964 | A | 5/1967 | Tripp | |
| 4,315,414 | A | 2/1982 | Ibrahim | |
| 4,416,120 | A | 11/1983 | Yono et al. | |
| 5,289,691 | A | 3/1994 | Schlosser et al. | |
| 5,373,961 | A | 12/1994 | Harris et al. | |
| 6,079,587 | A | 6/2000 | Vogt | |
| 6,536,224 | B1 * | 3/2003 | Frank et al. | 62/303 |

* cited by examiner

*Primary Examiner*—William E. Tapolcai
(74) *Attorney, Agent, or Firm*—Miles & Stockbridge P.C.; Edward J. Kondracki

(57) ABSTRACT

A device for use with a refrigeration case (104) having a defrost cycle comprising at least one intake (154, 156, 158) for receiving a cleaning agent (155), a rising agent, and a sanitizing agent (159), at least one fluid outlet (140) disposable in the refrigeration case and being in fluid communication with the at least one intake, and wherein transfer of the agents from the at least one intake to the at least one fluid outlet is dependent on the defrost cycle of the refrigeration case and the order of the release of the agents is the cleaning agent, the rinsing agent, and the sanitizing agent.

29 Claims, 5 Drawing Sheets

FIG.4
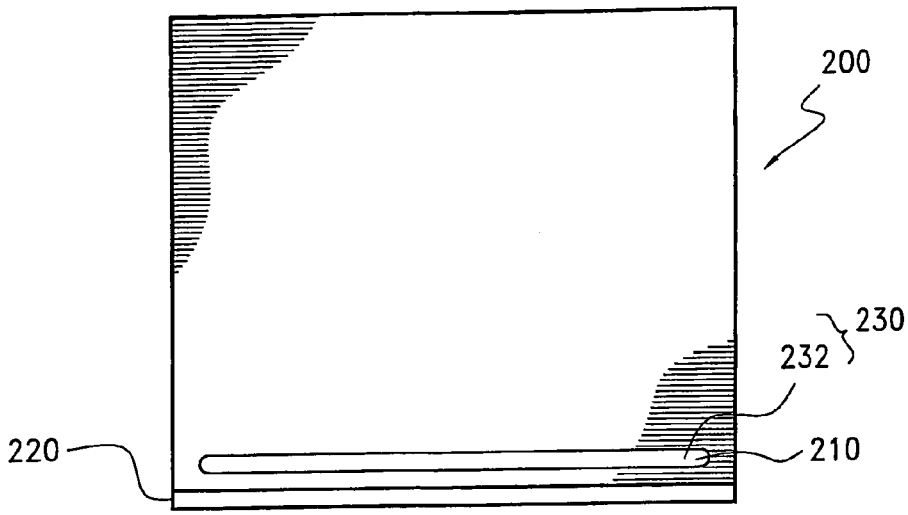
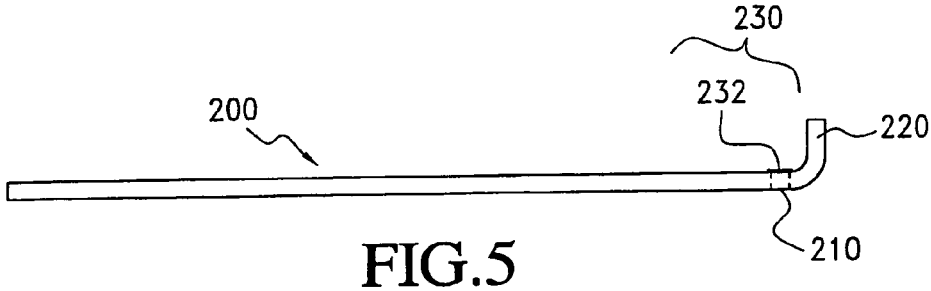
FIG.5
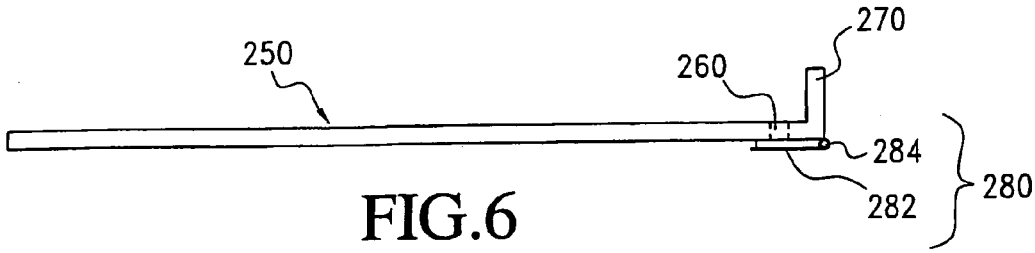
FIG.6
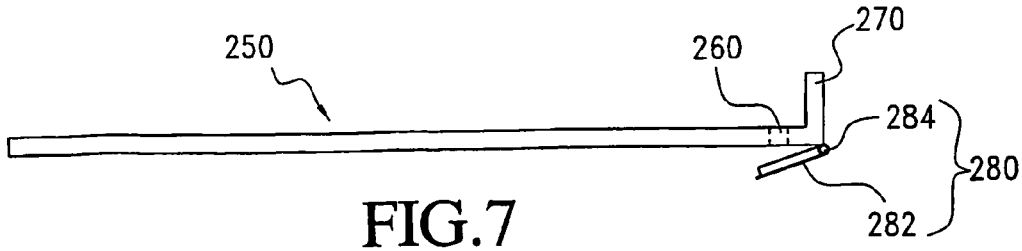
FIG.7

REFRIGERATED DISPLAY CASE AUTOMATIC CLEANING SYSTEM AND METHOD

CROSS-REFERENCE TO RELATED APPLICATION

This application claims the benefit of provisional application No. 60/310,833, filed on Aug. 9, 2001, which is herein incorporated by reference in its entirety.

BACKGROUND OF THE INVENTION

1. Field of Invention

This invention is related to systems and methods for cleaning refrigerated display cases.

2. Description of Related Art

There are numerous conventional display cases that display a variety of products and foods such as meat, dairy products, beverages and frozen food. These display cases have historically been unsanitary as they trap tissues, blood, or sugary syrups, such as the syrups contained in frozen fruit juice. For example, meat and poultry are usually displayed on top of small pads disposed on trays and generally wrapped in stretch film and a heat shield to prevent leakage. However, regardless of the type of packaging, some or all of the packages will eventually permit leakage through a seam or a tear of the wrapping.

The food or product packages are generally displayed on top of wire racks or trays, which are mounted on brackets attached to the walls of the display case. The leakage from the packages will generally drip down below the racks onto pans disposed in the bottom of the case. These drippings are unsightly to consumers and generally have horrible odors. Most importantly, the drippings are unsanitary.

The conventional or standard way of dealing with this problem is to manually unload all of the products from the display case onto rolling racks and move the racks into a chilled storage room if the product is temperature sensitive. The display case is then deactivated or turned off and washed by spraying water and cleaners into the case. After rinsing and drying, the product is placed back into the display case. This procedure requires a tremendous amount of time to perform.

An alternative solution is to line the cases with padding designed to absorb the drippings. This method is costly, messy, and still unsanitary.

To reduce the visibility of drippings to customers, black matting is often placed underneath the racks. However, the drippings and juices will eventually spoil to produce an unpleasant odor for the consumer. It is also still unsanitary. Further, these techniques still require the case to be periodically emptied and manually cleaned to remove the soiled pads and mats.

In order to cope with the problems and costs associated with manually cleaning a display case, designs of automatic cleaning systems have been developed such as those disclosed in U.S. Pat. Nos. 3,320,964, 4,315,414, 4,416,120, and 6,237,350. However, these automatic cleaning systems have numerous disadvantages and shortcomings.

SUMMARY OF THE INVENTION

A disadvantage of conventional automatic cleaning systems for display cases is that the systems fail to adequately clean, rinse and sanitize areas of a display case that have been soiled by food drippings.

Another disadvantage of prior art automatic cleaning systems for display cases is that they are not adaptable for any type of conventional or standard display case.

Further, the prior art automatic cleaning systems for display cases are not efficient and require extra shut down periods for refrigerated display cases in which the cleaning is to be performed. These extra shut down periods result in less refrigeration to the product making it difficult to maintain the proper product temperature.

Additionally, the prior art automatic cleaning systems for display cases have shortcomings and disadvantages in that they do not provide all of the features and advantages of this invention.

Accordingly, in light of the above, there is a strong need in the art for an efficient automatic system and method for adequately flushing a display case.

This invention provides an automatic system and method for flushing a display case.

This invention provides an automatic flush system having at least one agent intake in fluid communication with at least one fluid outlet, which is disposable in a display case. The agent intake receives at least one agent for flushing the case. The agent is provided to the fluid outlet through a delivery conduit that provides fluid communication between the agent intake and the fluid outlet.

This invention provides an automatic flush system for flushing a refrigerated display case wherein the flushing is dependent on a defrost cycle of the case. Refrigeration time is not compromised since flushing of the case takes advantage of existing defrost cycles.

This invention provides an automatic flush system utilizing a plurality of agents to flush the case.

This invention provides an automatic flush system having a plurality of agents to flush the case, wherein the plurality of agents includes a cleaning agent, a rinsing agent, and a sanitizing agent.

This invention provides an automatic flush system having a plurality of agents to flush the case, wherein the plurality of agents includes a cleaning agent, a rinsing agent, and a sanitizing agent, and wherein the order of the release of the agents into the case from the fluid outlet is the cleaning agent, the rinsing agent, and then the sanitizing agent.

This invention provides an automatic flush system having a system controller.

This invention provides an automatic flush system having a system controller that regulates the release of the agents.

This invention provides a method for flushing a refrigerated display case comprising the steps of detecting the onset of a defrost cycle and flushing the case in response to the onset of the defrost cycle.

This invention provides a method for flushing a display case comprising the steps of cleaning the case, rinsing the case, and sanitizing the case.

This invention provides a drip pan disposable in a display case having at least one opening at the perimeter of the pan, a lip disposed adjacent to the opening, and a member for controlling flow through the opening.

These and other features and advantages of this invention are described in or are apparent from the following detailed description of various exemplary embodiments of the systems and methods, according to this invention.

BRIEF DESCRIPTION OF THE DRAWINGS

Various exemplary embodiments will be described in detail, with reference to the following figures, wherein:

FIG. 4 is a top view of one embodiment of a preferred drip pan according to the invention;

FIG. 5 is a side view of one embodiment of the drip pan of FIG. 4, according to the invention;

FIG. 6 is a side view of one alternative embodiment of a drip pan with a flap in a closed position, according to the invention;

FIG. 7 is a side view of the drip pan of FIG. 6, with a flap in an open position, according to the invention.

DETAILED DESCRIPTION OF PREFERRED EMBODIMENTS

Figure 1:
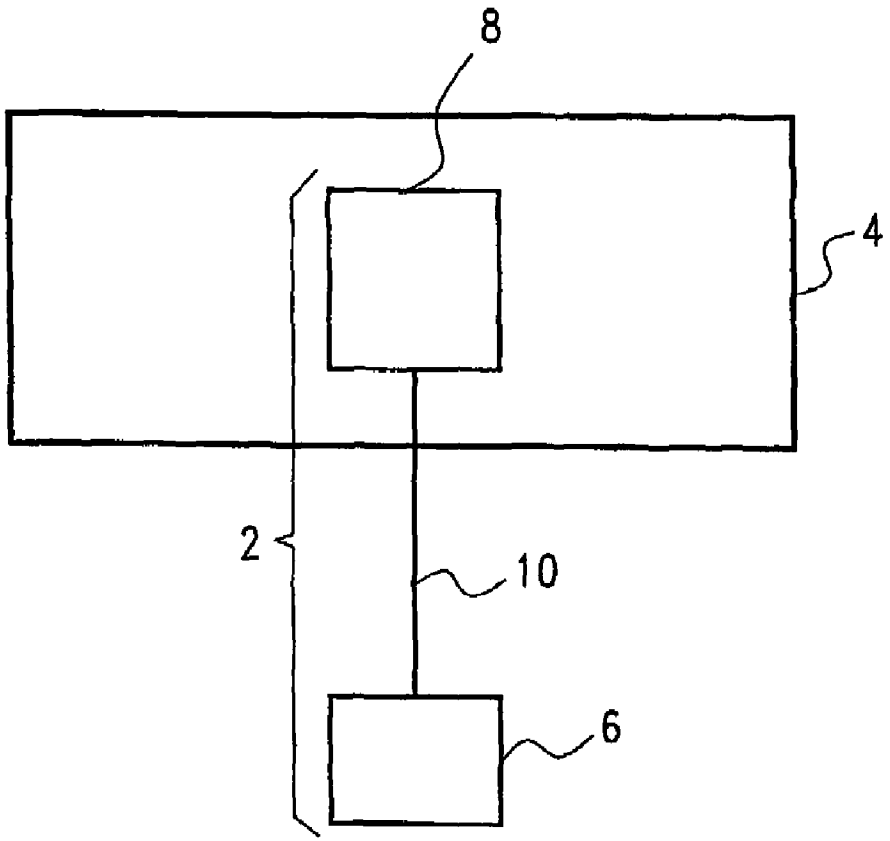
FIG. 1 is a schematic representation of an automatic flush system, according to the present invention.

FIG. 1 shows a schematic illustration of an automatic flush system 2, according to the invention. At least a portion of flush system 2 is disposable in a display case 4. It should be appreciated that the entire flush system 2 may be disposed within display case 4 and that system 2 can be configured to be operable with a variety of different types of cases. Flush system 2 includes at least one agent intake 6 and at least one fluid outlet 8. Agent intake 6 is in fluid communication with fluid outlet 8 by a delivery conduit 10.

Agent intake 6 receives at least one agent for flushing display case 4. Flushing display case 4 in various exemplary embodiments includes cleaning, rinsing, and sanitizing display case 4. It should be appreciated that different agents may be used to flush the case. The agents include, but are not limited to, cleaning agents, rinsing agents, and/or sanitizing agents. Also, different agents may be used for each phase of the flushing. In accordance with a preferred embodiment of the invention, the order of the use of the agents for the flushing is the cleaning agent, the rinsing agent, and the sanitizing agent. It also should be appreciated that flush system 2 may include a plurality of agent intakes 6.

Fluid outlet 8 is disposable in display case 4 for the discharge of any agent provided through delivery conduit 10. Fluid outlet 8 is adequately positioned so that the discharge of agents results in the flushing of case 4. Discharging agents into case 4 will remove unsanitary drippings or particles from the inside of case 4 as well as sanitize case 4.

Display case 4 is a refrigerated display case equipped with a defrost cycle. In accordance with a preferred embodiment, the flush system 2 is configured to discharge the agent from fluid outlet 8 during the defrost cycle of case 4. It should be appreciated that in other embodiments, display case 4 may be a non-refrigerated display case.

Figure 2:
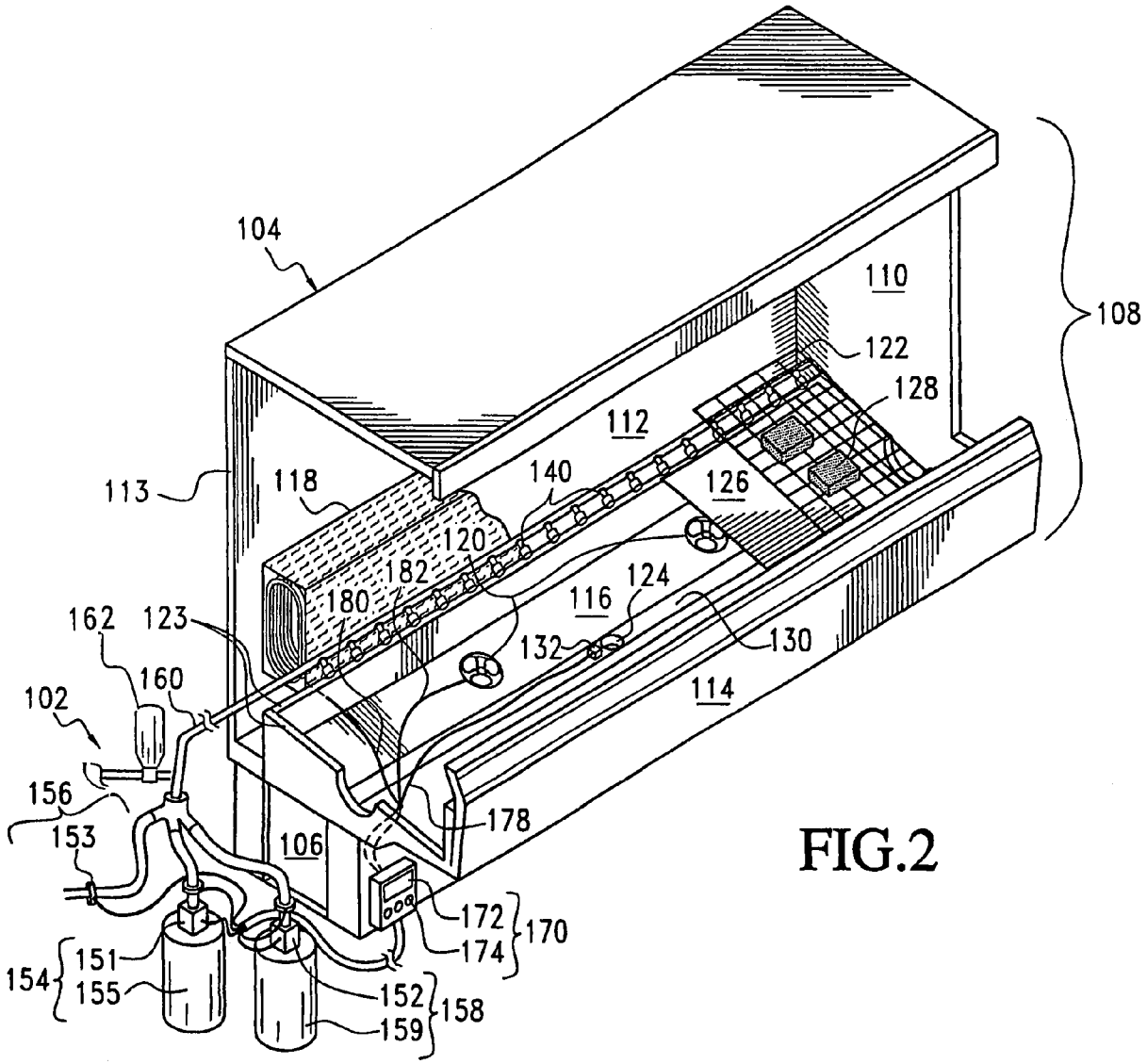
FIG. 2 is a broken perspective view of a refrigerated display case having an automatic flush system, according to the invention.
Figure 3:
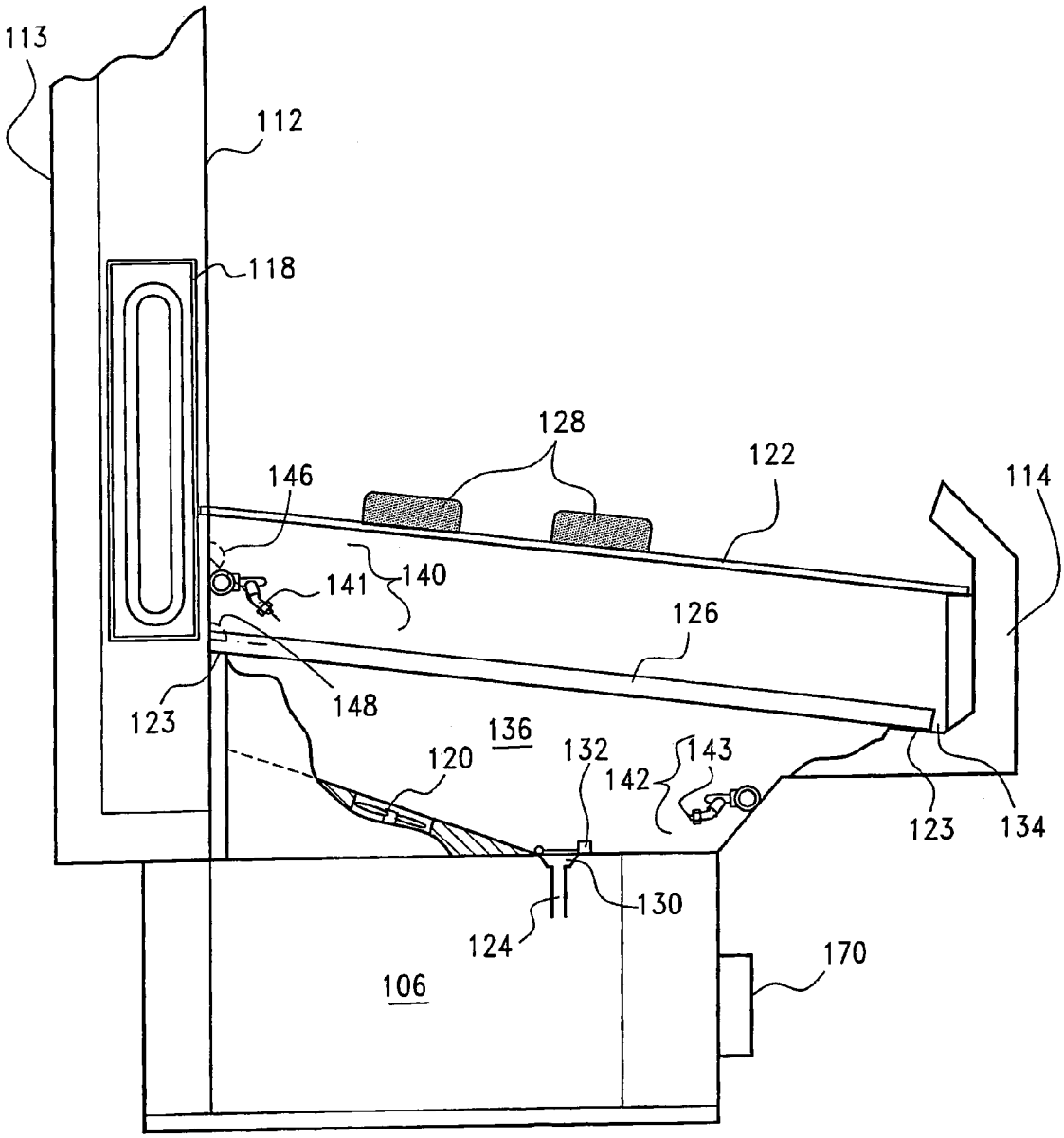
FIG. 3 is a side view of the refrigerated display case of FIG. 2, having an automatic flush system with nozzles, according to the invention.

FIGS. 2 and 3 illustrate a display case 104 having a flush system 102 according to a preferred embodiment of the invention.

Display case 104 may be any type of case for displaying food. Display case 104, in this exemplary embodiment is a refrigerated display case. Refrigerated display cases are generally used to display temperature sensitive food products such as meat and dairy products as well as frozen foods and beverages. Display case 104 includes a lower support 106 and an upper display cabinet 108.

Support 106 is situated on the floor and provides stability to upper display cabinet 108. Support 106 also elevates upper display cabinet 108 to an appropriate viewing level that is comfortable to individuals looking at any food or products on display.

Upper display cabinet 108 includes a number of walls. In this exemplary embodiment, upper display cabinet 108 includes sidewalls 110, a back exterior wall 113, a rear wall 112, a front wall 114, and a bottom wall 116.

Upper display cabinet 108 houses refrigeration coils 118, a plurality of fans 120, at least one display rack 122, at least one pan 126, and a drain outlet 124. It should be appreciated that there may be only one fan in other types of cases.

Refrigeration coils 118 cool refrigeration case 104 in a conventional manner and fans 120 circulate the cooled air. A defrost circuit (not shown) controls activation and deactivation of the refrigeration coils 118. In this exemplary embodiment, refrigeration coils 118 are disposed between back exterior wall 113 and rear wall 112. Fans 120 are disposed in a cavity 136 formed by bottom wall 116, sidewalls 110, and the underside of pans 126. A fan circuit (not shown) controls activation and deactivation of fans 120. In alternative embodiments, cavity 136 may also house other inner workings in addition to the fans, such as, for example, a defrost heater. In still other alternative embodiments, the refrigeration coils may be co-located with the fans in the cavity.

Display rack 122 mounts to one or more of upper display cabinet walls 110, 112, 114 to space it from bottom wall 116 of cabinet 108. In this embodiment, lower display rack 122 is a conventional open surface wire-type metal rack, such as those that are commonly used in refrigerated display cases. Food or food packages 128 may be placed on rack 122 for display. Packages 128 may include meat, dairy beverages, frozen foods, or the like. In other various exemplary embodiments, cabinet 108 may accommodate additional racks (not shown) for showcasing additional packages of food. Cabinet 108 preferably provides for multiple adjustments, which afford flexibility when placing any additional racks. It should be appreciated that rack 122 may be disposed in any manner that spaces it away from bottom wall 116 of cabinet 108.

At least one pan 126 is disposed between wall 116 and rack 122 of cabinet 108 in a conventional manner through the use of, for example, ledges 123 that run the length of walls 110, 112, 114 and support pan 126 from underneath. Pan 126 catches drippings that leak from packages 128 or moisture that may fall or drip through rack 122. The drippings, moisture, and fluids from the flushing process drain off pan 126 through an opening 134 between the front wall 114 and pan 126. Pan 126 is disposed with a slight tilt towards opening 134 to aid in the removal of fluid and drippings from upper cabinet 108. In an exemplary embodiment, a plurality of pans extends throughout the length of the display case.

Drain outlet 124 is disposed in bottom wall 116 of cabinet 108 to remove drippings and debris from case 104. Bottom wall 116 is preferably tilted to direct fluids to drain outlet 124. In this embodiment, a channel 130 in bottom wall 116 further achieves the transportation of fluids toward drain 124. Preferably, drain 124 is in fluid communication with a sewer line for removal of the fluids, although any method that facilitates removal of the fluid from drain 124 may be employed. In other embodiments, the case may have more than one drain to aid the efficient removal of drippings and debris. Further, a garbage disposal unit (not shown) may also be utilized to chop-up debris flushed out of the case.

In the event that drain 124 becomes clogged or if something has blocked drain 124, it is preferable that an alarm system signals such a finding. In this exemplary embodiment, the alarm system comprises a float safety switch 132 disposable at drain 124 of cabinet display 108. The float safety switch may have one or more of a variety of responses to an overflow, for example, an audible indicator, a visual indicator, a flush system automatic shut-off, etc. It should be appreciated that in alternative embodiments, any overflow detection device may be used.

Automatic flush system 102 includes a plurality of fluid outlets 140, 142 disposed in display case 104 and three agent intakes, namely, a cleaning agent intake 154, a rinsing agent intake 156, and a sanitizing agent intake 158. Automatic flush system 102 further includes a delivery conduit 160 and a system controller 170.

Fluid outlets 140, disposed in case 104 and as seen in FIGS. 2 and 3, are preferably disposed adjacent to rear wall 112. In the present embodiment, fluid outlets 140 are disposed between rack 122 and pan 126. It is still further preferred that fluid outlets 140 be disposed close to the top surface of pan 126. During the flushing process, fluids are discharged from fluid outlets 140 onto pan 126.

In this exemplary embodiment and as best shown in FIG. 3, fluid outlets 140 include nozzles 141 positioned along rear wall 112. Nozzles 141 are preferably pressurized, non-clogging, self draining, and preferably provide a sharp, distinctive spray with the possibility of pulsating action. Efficiency in the flushing of case 104 may be improved by using nozzles 141 with rotating faculties to direct fluid discharge in multiple directions. Although not shown in FIG. 3, the nozzles may be that of the dual-head type. A combination of these features would determine a suitable distance between each fluid outlet 140. It should be appreciated that other types of fluid outlets may be used so long as case 104 is adequately flushed while substantially preventing fluid from reaching food packages 126 on display racks 122.

As shown in FIG. 3, an angle 146 between rear wall 112 and nozzles 141 is preferred to be slightly greater than an angle 148 between rear wall 112 and pans 126 to appropriately deliver the fluid onto pans 126, (such as, for example, 0.5 degrees to 20 degrees). Further, the respective angles may also be substantially equal. Nozzles 141 may be adjustable to allow for fine-tuning of angle 146 for flushing efficiency.

FIG. 3 also shows the location of fluid outlets 142, which are not visible in FIG. 2. Fluid outlets 142 are disposable against front wall 114 in a manner consistent with fluid outlets 140 against rear wall 112. While fluid outlets 140 are positioned to flush the drip pans 126, fluid outlets 142 are positioned to flush cavity 136. Bottom wall 116, the underside of pans 126, and fans 120, as well as any other mechanisms of cavity 136, such as a fan cover assembly, are thoroughly flushed to remove any drippings or debris from food packages 128 or other sources. In this embodiment, fluid outlets 142 include nozzles 143 of a type similar to nozzles 141. Fluid discharge from nozzles 143 and remaining drippings that may have spilled onto bottom wall 116 are completely flushed out by nozzles 143 and removed through drain 124. While FIGS. 2 and 3 illustrate fluid outlets 142 disposable against front wall 114, it should be appreciated that fluid outlets 142 may alternatively be disposable against rear wall 112 in cavity 136. Such alternative placement may benefit from avoiding the atomization of food drippings or fluid on fluid outlets 142, which may eventually cause clogging. It should also be appreciated that fluid outlets 142 are optional and efficient flushing can be accomplished with fluid outlets 140 alone.

In the exemplary embodiment illustrated in FIG. 2, cleaning agent intake 154 and sanitizing agent intake 158 include a cleaning agent reservoir 155 and a sanitizing agent reservoir 159, and proportion pumps 151, 152, respectively. Cleaning agent reservoir 155 holds a cleaning agent and sanitizing agent reservoir 159 holds a sanitizing agent, each reservoir 155, 159 providing the respective agents to fluid outlets 140, 142. While FIG. 2 depicts reservoirs 155, 159 placed adjacent to case 104, their location is not limited to that shown. The reservoirs may be placed in any number of locations, for example, inside of support 106 or at a remote location, so long as there is fluid communication with delivery conduit 160. A warning device (not shown), such as an alarm, may be utilized to inform of low levels in the agent reservoirs, so as to indicate when the reservoirs should be replenished or, if they are disposable units, replaced with a new, full reservoir. It should be appreciated that in alternative embodiments, the cleaning or rinsing agent intakes may instead connect directly to a cleaning or rinsing communal supply feed, respectively, wherein the communal supply feed is an agent source supplying an agent to a plurality of destination devices.

Proportion pumps 151, 152 control the release of cleaning and sanitizing agents into delivery conduit 160. Once an agent is released into delivery conduit 160, proportion pumps 151, 152 may continue to pump the agents to fluid outlets 140, 142 for discharge into display case 104. While the present embodiment is described with the use of proportion pumps, any other type of flow-metering device may be used in addition to, or in place of, the proportion pumps.

Rinsing intake 156 includes valve 153 to regulate flow of a rinsing agent to fluid outlets 140, 142. Rinsing intake 156 has a direct connection to a rinsing agent communal feed, which in this case is a preexisting water line. Water is thus used as the rinsing agent. It should be appreciated that in alternative embodiments, the rinsing intake may instead connect to a rinsing agent reservoir and be arranged in a manner consistent with the cleaning agent and sanitizing agent intakes. It should be appreciated that water is not required to be used as the rinsing agent, although it is preferable. Any agent or combination of agents suitable for rinsing may be used as the rinsing agent.

While proportion pumps 151, 152 have thus far been described as the only source for fluidic movement of the cleaning and sanitizing agents through flush system 102, it should be appreciated that fluidic movement of the cleaning and sanitizing agents may alternatively rely on fluidic pressure from a communal feed such as, for example, the preexisting water line of the rinsing intake. In such an alternative embodiment, proportion pumps may still regulate the amount of cleaning and sanitizing agents released into the delivery conduit where it is mixed with water from the water line. The water pressure from the water line then carries the cleaning and sanitizing agents to the fluid outlets disposed in the display case. The success of this setup depends on a number of factors including, but in no way limited to, the pressurization level of the communal feed and the length of the delivery conduit. In other embodiments, the use of a water supply pump may be needed depending on water pressure requirements or pressure availability at the location. Care should be taken to prevent using an excess of pressure that may result in splashing of the agents and the possibility of atomization of the discharged fluids on to the food packages.

Delivery conduit 160 provides fluid communication between agent intakes 154, 156, 158 and fluid outlets 140, 142. It should be appreciated that the delivery conduit may be any device for providing fluid communication between the agent intakes and the fluid outlet, including, but not limited to, galvanized steel or copper pipe, stiff PVC (polyvinyl chloride) tubing, or flexible rubber or plastic tubing. In alternative embodiments, the display case may have preexisting conduits for the movement of fluids. In such an embodiment, the flush system may rely on a preexisting conduit or a portion of a preexisting conduit for fluid communication. Drain mechanism 162 is used for draining delivery conduit 160. It is often necessary to prevent damage in conduit 160 by freezing fluids when refrigeration is restored to case 104. Drain mechanism 162 drains delivery conduit 160 by vacuuming out excess fluids in conduit 160. However, it should be appreciated that other methods of draining conduit 160 may be employed, such as, but not limited to the use of air pressure, the use of gravity, etc. It should further be appreciated that drain mechanism 162 is optional.

System controller 170 regulates the influx of the cleaning agent, the sanitizing agent, and water to fluid outlets 140, 142 by adjusting proportion pumps 151, 152 or valve 153, or a combination thereof. In this exemplary embodiment, system controller 170 embodies an electronic system controller disposed adjacent to case 104. It should be appreciated that in alternative embodiments, the system controller need not embody an electronic device but may embody any method for regulating the influx of the agents or water to case 104. It should further be appreciated that system controller 170 is optional, such that pumps 151, 152 or valve 153 may retain independent or manual control.

System controller 170 communicates with a plurality of components of the automatic flush system via a plurality of communication links. In this exemplary embodiment, system controller 170 communicates with pumps 151, 152, valve 153, float safety switch 132, the defrost circuit (not shown), and the fan circuit (not shown) via communication links 176, 178, 180, and 182.

First communication links 176 exists between system controller 170 and pumps 151, 152 and valve 153. Communication links 176 enable system controller 170 to regulate the influx of agents from agent intakes 154, 156 and 158 by adjusting the operation of pumps 151, 152, and the open, closed, or intermediate position of valve 153.

A second communication link 178 exists between system controller 170 and float safety switch 132. In the event that float safety switch 132 is activated, system controller 170 receives feedback via communication link 178 and can take appropriate action, such as halting a flush process that is in progress to prevent overflow in case 104 and/or activate audible and/or visible attention indicators. It should be appreciated that float safety switch 132 may alternatively operate independent of system controller 170.

A third communication link 180 exists between system controller 170 and the defrost circuit. Communication link 180 permits system controller 170 to detect the onset of a defrost cycle through the detection of or absence of a voltage from the defrost circuit. Because defrost methods vary among cases, such as electric defrost methods, reverse air defrost methods, gas defrost methods, or offtime defrost methods, detection of the onset of a defrost cycle may vary. For example, the system controller may detect the onset of a defrost cycle in a refrigeration case using electric defrost methods through the detection of a voltage in the defrost circuit. In another example, the system controller may detect the onset of a defrost cycle in a refrigeration case using offtime defrost methods through the absence of a voltage in the refrigeration circuit. It should be appreciated that these examples are provided only for purposes of clarification and are not meant to be limiting.

A fourth communication link 182 may exist between system controller 170 and the fan circuit. Communication link 182 permits system controller 170 to interrupt fans 120 at predetermined intervals, such as for the duration of the flushing process in order to prevent uncontrolled spraying of fluids that are discharged from fluid outlets 140, 142.

In this embodiment, communication links 176, 178, 180 and 182 are wire links. It should be appreciated that communication links 176, 178, 180 and 182 can be a wired or wireless link. Further, it should be appreciated that links 176, 178, 180 and 182, can be linked to a network (not shown). The network can be a local area network, a wide area network, an intranet, the Internet, or any other distributed processing network.

In this exemplary embodiment, system controller 170 includes an input device 172 and a display 174.

Input device 172 provides the capability to alter various features of the system such as the amount and proportion of cleaning agent, sanitizing agent, and water sent to fluid outlets 140.

Display 174 of system controller 170 conveys data to an operator about the system. The data may include concentration levels of the agents, progress of a current flushing cycle, etc.

The system controller may in other embodiments include a printing and/or recording device configured to provide a hard copy or output of data relating to the flushing process. Thus, the controller could document variables such as the flushing frequency, agent concentrations, duration of the flushing, etc.

FIGS. 4–7 show two preferred embodiments for a drip pan according to the invention. Both of these pans 200, 250 comprise at least one opening 210, 260, a front lip 220, 270, and a member 230, 280 for controlling flow through opening 210, 260, respectively.

Referring now to FIGS. 4 and 5 and the first embodiment, opening 210 is disposed at one end of pan 200 to allow fluids to drain to the cavity below the drip pans towards the drain for removal from the display case.

Front lip 220 disposed near opening 210 prevents fluid from spilling or splashing out of pan 200 as it moves towards and drains through opening 210.

Member 230 includes a diaphragm 232 that permits the flow of fluid and debris downward through opening 210 for removal. Diaphragm 232 hinders the flow of air so as not to offset air circulation patterns created by the fans.

Referring now to FIGS. 6 and 7 and the second embodiment, member 280 of pan 250 includes a flap 282 and a hinge 284 disposed at opening 260. Flap 282 opens slightly during flushing of the case to allow fluid and debris to flow through opening 260 to the cavity below the drip pans towards the drain for removal from the display case. As illustrated in FIG. 6, flap 282 remains closed between flushing cycles so as not to offset air circulation patterns created by the fans. As illustrated in FIG. 7, tensioned spring hinges 284 engage flap 282 and pan 250 to allow a threshold weight of fluid and debris to push flap 282 downward, thereby allowing the fluid and debris to pass through opening 260. The absence of the threshold weight of fluid and debris, which is most likely prevalent between flushing cycles, keeps flap 282 closed, thereby hindering the passage of air through opening 260 and maintaining sufficient air circulation patterns for cooling the display case.

It is preferred that pans 200, 250 are composed of a molded plastic. However, it should be appreciated that other materials may be used. Pans 200, 250 may also be treated with a non-stick finish, for example Silicone, to facilitate the removal of drippings or shorten the drying time after a flush cycle.

This invention includes a method for flushing a refrigerated display case in response to the onset of a defrost cycle. The method includes detecting the onset of a defrost cycle and flushing the case in response thereto.

Figure 8:
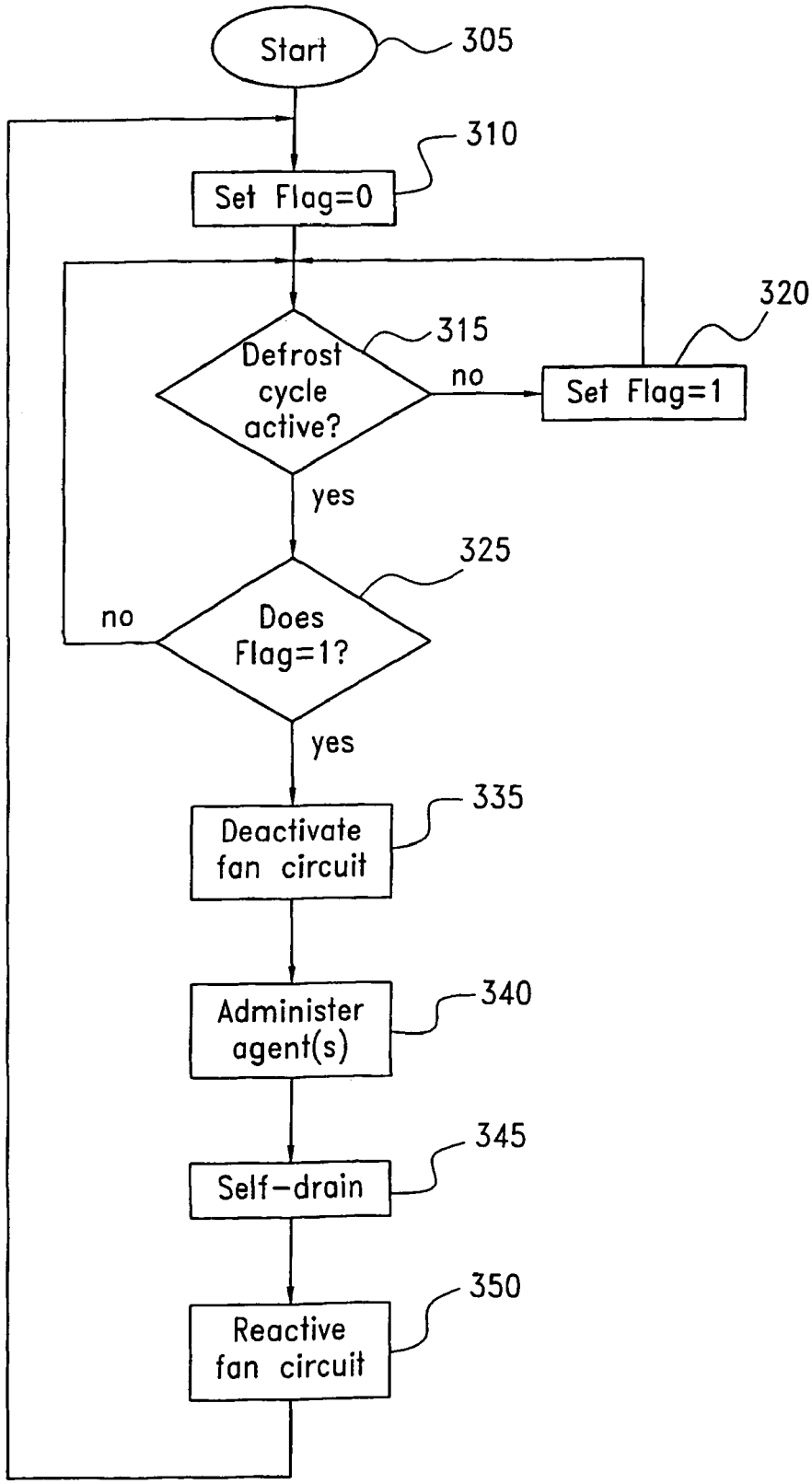
FIG. 8 is a flow diagram of a method for flushing a display case, according to the invention.

FIG. 8 illustrates a preferred method of flushing a display case according to the invention. For illustration purposes, the method is described with reference to the structure shown in FIGS. 2 and 3. It should be appreciated that the method is not limited to that structure.

The process begins at step 305 and proceeds to an initializing process at step 310. The initialization includes setting a flag equal to zero. The flag is used by system controller 170 in order to prevent the execution of two consecutive flushes within a single defrost cycle. If the flag is set to a value of zero, system controller 170 will not flush case 104 in the current defrost cycle. This prevents the agents from being administered in the middle or towards the end of an existing defrost cycle and risking administering an agent in a refrigeration cycle. Conversely, if the flag is set to a value of one, system controller 170 will begin flushing at the onset of the next defrost cycle. The process proceeds to step 315, wherein it is determined if a defrost cycle is currently active. If a defrost cycle is currently active, the process proceeds to step 325 wherein it is determined if the flag is set to a value of one. If the flag equals one at step 325, the process proceeds to step 335, otherwise, the process loops back to step 315. If at step 315, it is determined that a defrost cycle is not currently active, the flag is set to a value of one at step 320, which then proceeds back to step 315. At step 335, the fan circuit is deactivated. Then, at step 340, the agents are administered to the case. The system is self drained at step 345, and at step 350 the fan circuit is reactivated.

In further detail, system controller 170 detects whether there is a defrost cycle active at step 315 using communication link 180 to the defrost circuit. It should be appreciated that the system controller is not limited to detecting a defrost cycle in this manner and may vary in other embodiments. If the defrost cycle is not active, the flag is set to a value of one at step 320, indicating that the flush process should begin in the next defrost cycle. If at step 315 it has been determined that the defrost cycle is active, a check is performed at step 325 to verify if the flag is set to a value of one. If it is determined that the flag is not set to a value of one, the system determines that case 104 is in the middle of a defrost cycle and flushing should not begin. If it is determined that the flag is set to a value of one, system controller 170 is indicating that case 104 has just begun a new defrost cycle and the process proceeds to step 335. It should be appreciated that a counter could be used with the flag, such that the flushing occurs at a preferred defrost cycle interval.

The fan circuit is deactivated at step 335 by system controller 170 using communication link 182. Deactivation of the fan circuit prevents uncontrolled spraying of the agents discharged from fluid outlets 140, 142. It should be appreciated that steps 335 and 350 are not required steps for operation of flush system 102.

Administering the agents at step 340 includes flushing case 104. System controller 170 adjusts proportion pumps 151, 152, and valve 153 of agent intakes 155, 158 and 156, respectively, to permit the correct amount of agent to flow to delivery conduit 160 and fluid outlets 140, 142. Fluid outlets 140 discharge the agents onto drip pans 126 as fluid outlets 142 discharge the agents into cavity 136. It should be appreciated that the force of the pressure spray, a pulsating action of the spray, chemical properties of the agents, or other means may be used to assist in removing the unsanitary drippings.

In a preferred embodiment, the step of administering the agents 340 includes three cycles.

In the first cycle of the preferred three-cycle embodiment, system controller 170 adjusts proportion pump 151 of cleaning agent intake 154 for administering an appropriate amount of cleaner for the cleansing of pans 126 and cavity 136. The cleaning agent flows through delivery conduit 160 to fluid outlets 140, 142. Fluid outlets 140, 142 discharge the cleaning solution onto pans 126 and into cavity 136, respectively, to remove the drippings.

The cleaning agent that is discharged from fluid outlets 140 flows away from rear cabinet wall 112 of upper cabinet display 108 down the tilt of pans 126. The cleaning agent, now containing drippings from the food and debris that has been removed from the surface of pans 126, passes through opening 134 of pans 126 and into channel 130 of bottom wall 116. The cleaning agent discharged from fluid outlets 142 also flows away from rear cabinet wall 112, down the tilt of bottom wall 116, and into channel 130. Channel 130 directs the fluid, unwanted drippings, and debris towards drain 124 for removal.

The second cycle rinses the cleaning solution from pans 126 and cavity 136 with the rinsing agent. Preferably, the rinsing agent is water. System controller 170 regulates the amount of water used for the rinsing cycle by valve 153 of rinsing agent intake 156. Water from the second cycle drains in a fashion identical to the fluid of the first cycle. While it is preferable that the rinsing agent is water, the rinsing agent may be any number of other suitable rinsing agents.

The third cycle administers the sanitizing agent. System controller 170 adjusts proportion pump 152 of sanitizer agent intake 158 for administering an appropriate amount of sanitizer for sanitizing pans 126 and cavity 136. The sanitizing agent flows through delivery conduit 160 to fluid outlets 140, 142, which spray pans 126 and cavity 136 with the proper amount of antibacterial sanitizer product. Again, the fluid drains in a fashion identical to the previous cycles.

It should be appreciated that duration of each of the three cycles may be left to the discretion of the operator. The duration may be set through system controller 170 or set to default values. While it is preferred that the three cycle embodiment described herein is used for flushing case 104, it should be appreciated that the number, the combination of the cycles and/or the order of the cycles may vary in different applications.

While the present exemplary embodiment flushes the case in a parallel fashion in which fluid outlets 140 and fluid outlets 142 discharge fluid simultaneously, it should be appreciated that flushing of the case may be in a sequential fashion. For example, fluid outlets 140 may first flush pans 126. Subsequent to the draining of this fluid, fluid outlets 142 may then flush cavity 136.

Although not required, one or more chemicals may be introduced at step 340 that are directed towards dissolving particular food drippings in the case. For example, a chemical with particular de-coagulation properties may be introduced into the case specifically for the dissipation of coagulated milk.

At the completion of the flushing step 340 of the present embodiment, flush system 102 self-drains at step 345 in order to remove all remaining agents from fluid outlets 140 and any tubes or pipes. This is typically accomplished using a flush solenoid valve integral with fluid outlets 140, 142 or using drain mechanism 162 (described above), or a combination thereof. It should be appreciated that step 345 is optional.

The fan circuit is re-engaged to resume its normal operational state at step 350. It should be appreciated that step 350 is not a required step if step 335 was not performed.

Once the agents have been administered to case 104, system controller sets the flag to a value of zero at step 310. The frequency of flushing in relation to the defrost cycle may vary and depends on, among other factors, the amount of drippings or spillage into case 104. While the preferred embodiment flushes the case at every defrost cycle, it should be appreciated that the case may be flushed, for example, every other defrost cycle, twice every defrost cycle, etc. System controller 170 may be set to specific parameters accordingly.

While it is preferred that case 104 is flushed during a defrost cycle, it should be appreciated that the detection of the defrost cycle is not required. Flush system 102 may flush the case at any time using system controller 170 or, for example, a manual override or bypass switch (not shown). It should also be appreciated that the use of the flags described herein is only one way to determine the onset of a defrost cycle and other ways may be employed.

It should also be appreciated that the agents described herein may be in an alternative form, such as a concentrated or powdered form. System controller 170 may be programmed to regulate the concentration levels of the agents used in the flush process by regulating the operation of proportion pumps 151, 152 and valve 153. In this embodiment, water is used as the rinsing agent so system controller 170 can adjust valve 153 of rinsing agent intake 156 in combination with proportion pumps 151 and 152 of intakes 154 and 158, respectively, to attain appropriate concentration levels of the cleaning and sanitizing agents.

It should also be appreciated that any of the agents may be conditioned to offer advantages such as anti-corrosives, antibacterial agents, etc. These may offer other benefits such as prolonging the life of the case and its parts.

While this invention has been described in conjunction with the specific embodiments outlined above, it is evident that many alternatives, modifications and variations will be apparent to those skilled in the art. Accordingly, the embodiments of the invention, as set forth above, are intended to be illustrative, not limiting. Various changes may be made without departing from the spirit and scope of this invention.

What is claimed is:

1. A device for use with a refrigeration case having a defrost cycle comprising:

at least one intake for receiving a cleaning agent, a rinsing agent, and a sanitizing agent;

at least one fluid outlet disposable in the refrigeration case being in fluid communication with the at least one intake;

an overflow detection device disposable in the refrigeration case;

at least one proportion pump associated with the at least one intake for regulating the fluid communication between the at least one intake and the at least one fluid outlet and wherein release of the agents from the at least one intake to the at least one fluid outlet is dependant on the defrost cycle of the refrigeration case and the order of release of the agents is the cleaning agent, the rinsing agent, and the sanitizing agent.

2. The device of claim 1, wherein the at least one intake includes a reservoir for supplying an agent.

3. The device of claim 1, wherein the at least one intake includes a plurality of intakes.

4. The device of claim 3, wherein the plurality of intakes includes a cleaning agent intake, a rinsing agent intake, and a sanitizing agent intake.

5. The device of claim 4, wherein the cleaning agent intake and the sanitizing agent intake each includes an agent reservoir for supplying the cleaning agent and the sanitizing agent, respectively.

6. The device of claim 4, wherein the rinsing agent intake is in fluid communication with a water supply feed.

7. The device for use with a refrigeration case having a defrost cycle comprising:

at least one intake for receiving a cleaning agent, a rinsing agent, and a sanitizing agent;

at least one fluid outlet disposable in the refrigeration case being in fluid communication with the at least one intake;

an overflow detection device disposable in the refrigeration case, and wherein release of the agents from the at least one intake to the at least one fluid outlet is dependant on the defrost cycle of the refrigeration case and the order of release of the agents is the cleaning agent, the rinsing agent, and the sanitizing agent.

8. The device of claim 7, wherein the at least one intake includes a plurality of intakes and the at least one fluid outlet includes a plurality of fluid outlets.

9. The device of claim 7, wherein the at least one fluid outlet is a nozzle.

10. The device of claim 7, further comprising a system controller.

11. The device of claim 7, further comprising a drain mechanism for removing fluid in communication with the at least one fluid outlet and the at least one intake.

12. The device of claim 10, further comprising:

at least one valve associated with the at least one intake;

wherein the system controller regulates the opening and closing of the at least one valve; and wherein the at least one valve regulates the fluid communication between the at least one intake and the at least one fluid outlet.

13. The device of claim 10, further comprising:

at least one proportion pump associated with the at least one intake;

wherein the system controller adjusts the operation of at least one proportion pump; and wherein the at least one proportion pump regulates the fluid communication between the at least one intake and the at least one fluid outlet.

14. The device of claim 10, wherein the system controller is configured to detect the onset of the defrost cycle of the refrigeration case.

15. The device of claim 10, further comprising an overflow detection device disposable in the refrigeration case and in communication with the system controller.

16. The device of claim 10, wherein the refrigerated display case includes at least one fan having a fan circuit, and wherein the system controller activates/deactivates the fan circuit at predetermined intervals.

17. The device of claim 10, wherein the system controller includes a display.

18. The device of claim 10, wherein the system controller includes an input device.

19. A device for use with a refrigeration case having a defrost cycle, as set forth in claim 1 wherein the order of release of agents from the at least one intake to the at least one fluid outlet is dependant on the defrost cycle of the refrigeration case.

20. A device for use with a refrigeration case, as set forth in claim 7 wherein the order of release of agents from the at least one intake to the at least one fluid outlet is the cleaning agent, the rinsing agent, and the sanitizing agent.

21. A refrigerated display case as set forth in claim 7 wherein release of agents from the at least one intake to the at least one fluid outlet is dependant on the defrost cycle of the refrigeration case.

22. The device of claim 7 further including a drip pan for use in the refrigeration case, the drip pan comprising:

a flow regulating member disposed adjacent the at least one opening and operably configured to regulate the flow of a fluid through the opening.

23. The device of claim 22, wherein the flow regulating member is a diaphragm.

24. The device of claim 7, wherein the plurality of intakes includes a cleaning agent intake, a rinsing agent intake, and a sanitizing agent intake.

25. The device of claim 7, wherein the cleaning agent intake and the sanitizing agent intake each includes an agent reservoir for supplying the cleaning agent and the sanitizing agent, respectively and wherein the release of the agents is dependant on the defrost cycle of the refrigeration case.

26. A device for use with a refrigeration case having a defrost cycle comprising:

a plurality of intakes for receiving agents including a cleaning agent, a rinsing agent, and a sanitizing agent;

a plurality of fluid outlets disposable in the refrigeration case and in fluid communication with the plurality of intakes;

a reservoir for supplying an agent to the intakes, namely a cleaning agent, a rinsing agent, and a sanitizing agent;

wherein release of the agents from the at least one intake to the at least one fluid outlet is dependant on the defrost cycle of the refrigeration case and the order of release of the agents is the cleaning agent, the rinsing agent, and the sanitizing agent and an overflow protection device disposed in the refrigeration case.

27. The device of claim 26 further comprising:

a system controller configured to detect the onset of a defrost cycle in the refrigeration case and for regulating the opening and closing of the at least one valve associated with at least one intake, wherein the at least one valve regulates the fluid communication between the at least one intake and the at least one fluid outlet.

28. The device of claim 27, further comprising:

at least one proportion pump associated with the at least one intake;

wherein the system controller adjusts the operation of at least one proportion pump; and wherein the at last one proportion pump regulates the fluid communication between the at least one intake and the at least one fluid outlet.

29. The device of claim 28, further including a flush system having a defrost cycle, the flush system being connected to at least one intake adapted to receive an agent and to at least one fluid outlet in the refrigeration case in fluid communication with the at least one intake connected to the flush system.

* * * * *